US008833525B2

(12) United States Patent
Gerstenkorn et al.

(10) Patent No.: US 8,833,525 B2
(45) Date of Patent: Sep. 16, 2014

(54) METHOD AND SYSTEM FOR OPERATING AN ELEVATOR SYSTEM RESPONSIVE TO MOVEMENT OF BUILDING DOOR

(71) Applicant: Inventio AG, Hergiswil (CH)

(72) Inventors: Bernhard Gerstenkorn, Ebikon (CH); Kilian Schuster, Lucerne (CH); Paul Friedli, Remetschwil (CH)

(73) Assignees: Inventio AG, Hergiswil (CH); Ingersoll Rand Security Technologies, Carmel, IN (US)

( * ) Notice: Subject to any disclaimer, the term of this patent is extended or adjusted under 35 U.S.C. 154(b) by 0 days.

(21) Appl. No.: 14/021,175

(22) Filed: Sep. 9, 2013

(65) Prior Publication Data

US 2014/0014442 A1 Jan. 16, 2014

Related U.S. Application Data

(63) Continuation of application No. 12/990,103, filed as application No. PCT/EP2008/055193 on Apr. 28, 2008, now Pat. No. 8,556,042.

(51) Int. Cl.
*B66B 1/16* (2006.01)
*B66B 1/46* (2006.01)

(52) U.S. Cl.
CPC ..... *B66B 1/16* (2013.01); *B66B 2201/4615* (2013.01); *B66B 2201/463* (2013.01); *B66B 2201/4638* (2013.01); *B66B 2201/4676* (2013.01); *B66B 1/468* (2013.01)
USPC ..... 187/388; 187/391

(58) Field of Classification Search
USPC ..... 187/247, 248, 380–388, 391–393, 396; 704/270, 273, 375; 340/5.1–5.33, 5.61, 340/5.8, 5.81
See application file for complete search history.

(56) References Cited

U.S. PATENT DOCUMENTS 4,837,822 A 6/1989 Crosley et al.
4,979,594 A 12/1990 Begle et al.

(Continued)

FOREIGN PATENT DOCUMENTS

DE 3124714 A1 1/1989
EP 0699617 A 3/1996

(Continued)

OTHER PUBLICATIONS

Kone IDE300 Brochure, 2008, pp. 1-8.

*Primary Examiner* — Anthony Salata
(74) *Attorney, Agent, or Firm* — Fraser Clemens Martin & Miller LLC; William J. Clemens

(57) ABSTRACT

A method including: detecting movement of a building door on a floor of a building; based on the detected movement of the building door, defining the floor of the building as a start floor for an elevator trip with an elevator system in the building; and based on the detected movement of the building door, placing a predefined destination call for the elevator trip. The detecting can include determining that a passenger is passing through the building door. A system for performing the method includes: a sensor; an elevator installation in the building; and a control unit coupled to the sensor and to the elevator installation, and configured to detect the door movement using the sensor, define the floor of the building as the start floor, and place a predefined destination call for the elevator trip.

20 Claims, 7 Drawing Sheets

(56) References Cited

U.S. PATENT DOCUMENTS

| | | | |
|---|---|---|---|
| 5,092,430 | A | 3/1992 | Goto et al. |
| 5,689,094 | A | 11/1997 | Friedli et al. |
| 6,109,396 | A | 8/2000 | Sirag et al. |
| 6,382,363 | B1 | 5/2002 | Friedli |
| 7,190,256 | B2 | 3/2007 | Pieper |
| 7,319,383 | B2 | 1/2008 | Howard |
| 7,353,915 | B2 | 4/2008 | Zaharia et al. |
| 7,377,364 | B2 | 5/2008 | Tyni et al. |
| 7,446,644 | B2 | 11/2008 | Schaffzin et al. |
| 7,581,622 | B2 | 9/2009 | Amano |
| 7,650,966 | B2 | 1/2010 | Sansevero et al. |
| 7,664,464 | B2 | 2/2010 | Gerstenkorn |
| 7,717,238 | B2 | 5/2010 | Hamaji et al. |
| 7,729,691 | B2 | 6/2010 | Newville |
| 7,791,452 | B2 | 9/2010 | Carrieri |
| 7,841,450 | B2 | 11/2010 | Smith et al. |
| 8,061,485 | B2 | 11/2011 | Finschi |
| 8,210,321 | B2 | 7/2012 | Finschi et al. |
| 8,230,979 | B2 | 7/2012 | Finschi et al. |
| 8,290,781 | B2 | 10/2012 | Gazdzinski |
| 8,556,042 | B2 * | 10/2013 | Gerstenkorn et al. ..... 187/388 |
| 2003/0155778 | A1 | 8/2003 | Dom |
| 2008/0217112 | A1 | 9/2008 | Puskala et al. |
| 2009/0120727 | A1 | 5/2009 | Hamaji et al. |
| 2011/0031070 | A1 | 2/2011 | Gerstenkorn et al. |
| 2011/0048864 | A1 | 3/2011 | Gerstenkorn et al. |
| 2012/0037458 | A1 | 2/2012 | Gerstenkorn |
| 2012/0234058 | A1 | 9/2012 | Neil et al. |
| 2012/0241259 | A1 | 9/2012 | Flynn et al. |

FOREIGN PATENT DOCUMENTS

| | | | |
|---|---|---|---|
| EP | 0832838 | A1 | 4/1998 |
| FR | 2744435 | A | 8/1997 |
| JP | 02310271 | A | 12/1991 |
| JP | 04032470 | A | 2/1992 |
| JP | 04144886 | A | 5/1992 |
| JP | 05201633 | A | 8/1993 |
| JP | 05229747 | A | 9/1993 |
| JP | 2000001283 | A | 6/1998 |
| JP | 2002104747 | A | 9/2000 |
| JP | 200522821 | A | 7/2003 |

* cited by examiner

TABLE OF DESCRIPTIVE LEGENDS FOR FIGURES 1-10

| Reference Numeral and/or Character | Description |
|---|---|
| 1, 1', 1" | floor level |
| 2, 2', 2" | building door |
| 3, 3', 3" | elevator door |
| 4 | elevator control |
| 5 | elevator drive |
| 6 | support means |
| 7 | elevator car |
| 8 | counterweight |
| 10 | mobile call input device |
| 9, 9', 9" | terminal |
| 20, 20', 20" | door sensor |
| 30, 30', 30" | elevator sensor |
| 31 | door drive |
| 40 | antenna |
| 70 | car sensor |
| 90, 90', 90" | recognition device |
| 91, 91', 91" | call input device |
| 92, 92', 92" | output device |

Fig. 11

METHOD AND SYSTEM FOR OPERATING AN ELEVATOR SYSTEM RESPONSIVE TO MOVEMENT OF BUILDING DOOR

CROSS-REFERENCE TO RELATED APPLICATIONS

This application is a continuation of the co-pending U.S. patent application Ser. No. 12/990,103 filed Oct. 28, 2010.

FIELD OF THE INVENTION

This invention relates to a method of using an elevator system, an elevator system for such a method and a method of retrofitting such an elevator system.

BACKGROUND OF THE INVENTION

A control device for an elevator is known from EP 0 832 838 A1, which makes it possible for an occupant to provide for a visitor, immediately when a building door is opened, an elevator car which conveys the visitor exactly to the correct floor of the occupant without either the occupant or the visitor having to actuate a button for use of the elevator.

A method is known from JP 04 032470 A or FR 2 744 435 A in which a call for an elevator is initiated when a person is identified via, for example, an identification card when entering a building. In the process, any potential authorization of the person is checked so that the elevator is only called if the person is authorized.

BRIEF SUMMARY OF THE INVENTION

An object of the present invention is to further develop these known methods for the use of an elevator.

This object is fulfilled according to the invention with a method for operating an elevator system and an elevator system functioning according to the method, as well as with a method for retrofitting an elevator system with the features of the invention.

In the method of operating an elevator system according to the present invention, the floor in which the respective building door located is defined as the start floor by opening and/or closing a building door. A start call for an elevator car to the start floor is actuated. As soon as the elevator car has reached the start floor, the elevator door of the start floor is opened. A predefined destination call stored for the start floor is actuated, such that the respective user of the elevator system, without any further intervention, can reach a destination floor designated by the destination call.

A door sensor allocated in particular to the building door detects the opening and/or closing of the building door and, for a detected opening and/or closing, communicates at least one door signal to at least one elevator control. The elevator control defines the floor of the communicated door signal as the start floor and actuates a start call for an elevator car to the start floor. At least one elevator sensor detects the arrival of the elevator car in the start floor. For a detected arrival of the elevator car in the start floor, the elevator sensor communicates at least one elevator car signal to the elevator control. Upon communication of an elevator car signal, the elevator control opens the elevator door of the start floor and the elevator control furthermore actuates for the elevator car a predefined destination call, which is stored for the start floor, to a destination floor.

This has the advantage that a user does not have to actuate a start call for an elevator car. As soon as the user, by opening and/or closing a building door, indicates his/her desire to use the elevator system, the start call is automatically actuated for him/her and the elevator door is automatically opened for him/her. Furthermore, no destination call needs to be actuated. This is automatically actuated by the elevator control by means of relevant information stored for the start floor.

The building door can be an access door to an apartment in the building and/or an access door to the building.

The building door can be an access door to an apartment in the building and/or an access door to the building.

This has the advantage that the user does not have to actuate a start call for an elevator car either upon entering or leaving an apartment or the building, and that a destination call saved for the respective start floor is automatically actuated.

Advantageously, the start floor is defined only when the building door is opened from a side facing away from the elevator door and/or when the building door is closed from a side facing the elevator door.

It is thus ensured that a user, upon opening and/or closing the building door, actually moves towards an elevator door.

With regard to the destination call, which is actuated for the elevator car, to a destination floor, a predefined destination call stored for a start floor is actuated by the elevator control. Additionally or even alternatively, the user is identified by at least one recognition device and a predefined destination call stored for the identified user is actuated. For this purpose, the recognition device advantageously communicates at least one user recognition signal to the elevator control for an identified user. The elevator control actuates a predefined destination call for the elevator car to a destination floor, this call being stored for the communicated user recognition signal.

This has the particular advantage that the user does not have to actuate a start call or a destination call. This saves time, since the user, upon entering or departing from the building, does not have to stop his or her movement in order to activate an input keypad for a destination call. Such stopping of movement is tiresome and time-consuming particularly for users who are carrying bags or luggage with both hands.

The user can advantageously change the stored predefined destination call and actuate a personal destination call with at least one call input device. In this respect, known stationary or mobile devices come into consideration as the call input device and for first differing mounting locations, e.g. near an elevator door.

In case of a corresponding call input device, the destination call can be actuated contactlessly.

This has the additional advantage that the user thus has the possibility of situationally adapting a stored predefined destination call. Thus, for a start floor at the 10th floor of a building, a destination floor can be stored in predefined manner at the ground floor of the building. Such an allocation corresponds to the standard case according to which the user takes the elevator in the morning from his or her apartment in the start floor to the destination floor on the ground floor in order to leave the building. However, if the user now wants to travel by the elevator from his or her apartment to the 20th floor in order to enjoy the attractive view in an evening, he or she can temporarily change the destination floor.

The opened elevator door can be closed automatically by the elevator control as soon as at least one user has entered the elevator car. For this purpose, at least one car sensor detects entry of the elevator car by at least one user. For a detected entry of the elevator car by a user, the car sensor communicates at least one elevator car use signal to the elevator control. The elevator control closes the opened elevator door when an elevator car use signal is communicated and the user is conveyed by the elevator car to a destination floor. The user can thus be conveyed quickly and efficiently into the destination floor.

In the case of the method of retrofitting an elevator system, the building, i.e. in particular individual building doors and a control, and an elevator control are adapted such that there comes into being an elevator system as described here and subsequently and such that, using the elevator system, it becomes possible to implement the system as described here and subsequently.

The door sensor and/or the recognition device can be integrated into the building door and are thus barely perceived by the user.

Alternatively, the door sensor and/or the recognition device are mounted near the building door, such that conventional building doors can be used in particular in the event of a retrofitting.

If at least one antenna is installed, the door sensor can communicate at least one door signal via at least one radio network to the elevator control or the control and/or the recognition device can communicate at least one user recognition signal via the radio network to the elevator control or the control.

The wireless data communication avoids the necessity of laying of data cables.

BRIEF DESCRIPTION OF THE SEVERAL VIEWS OF THE DRAWING

Examples of embodiment of the invention are explained in detail by way of the figures. For this purpose, the following are shown in partly schematic form:

FIG. 11 is a table of descriptive legends for the reference numbers and letters shown in FIGS. 1-10.

DETAILED DESCRIPTION OF THE INVENTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
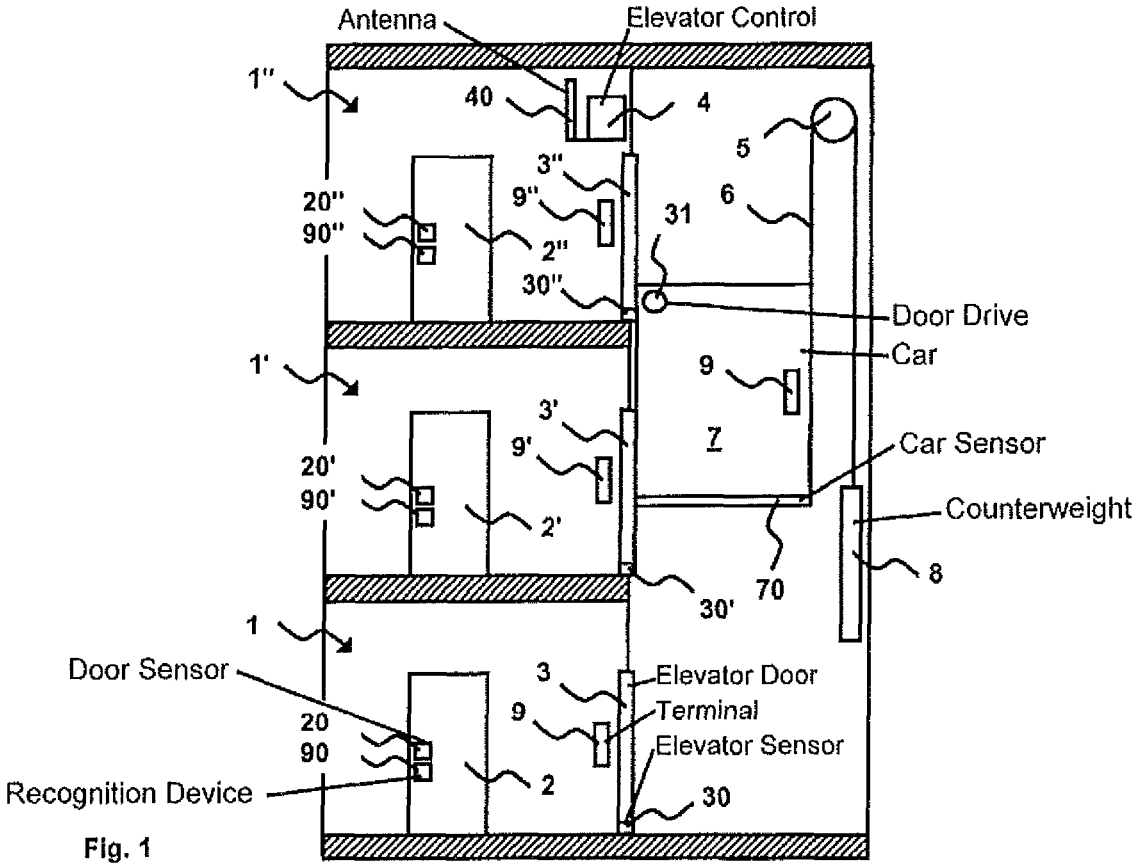
FIG. 1 is a partially sectioned view of a part of an elevator system in a building.
Figure 2:
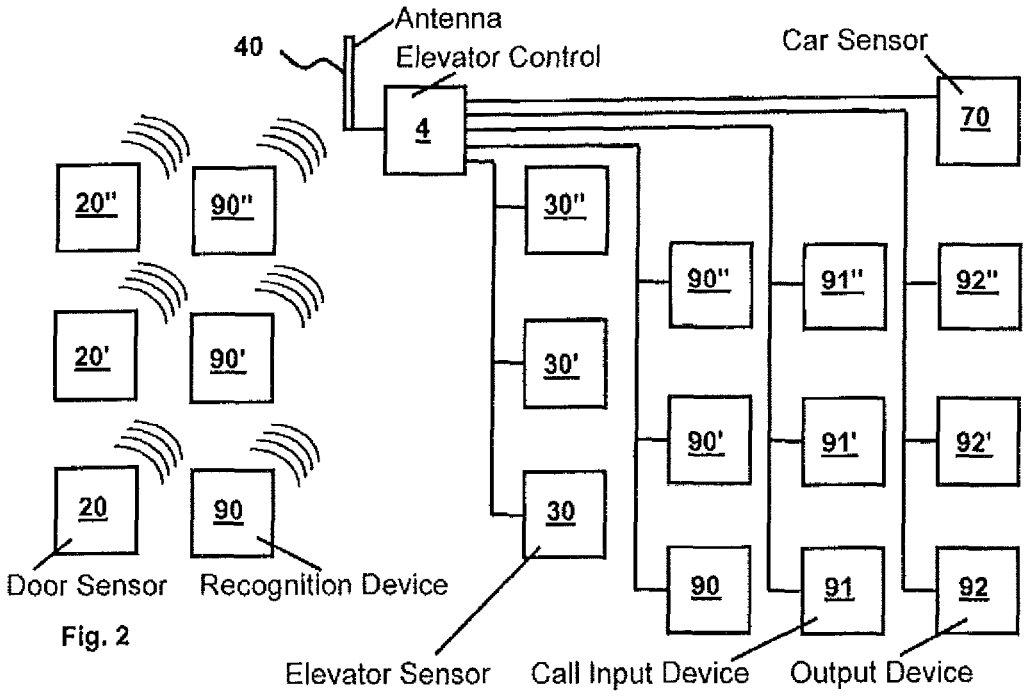
FIG. 2 is a partially sectioned view of a part of a network of an elevator system according to FIG. 1.
Figure 3:
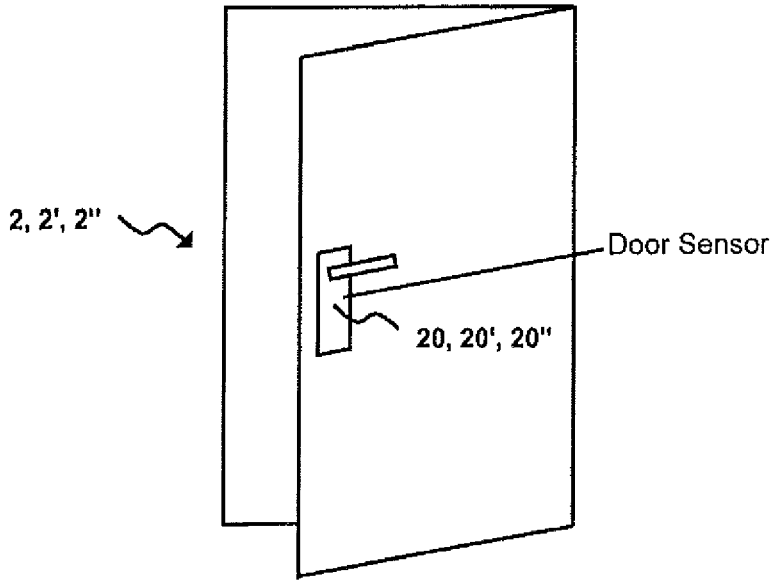
FIG. 3 is a view of a part of a first embodiment of a building door with door sensor for the elevator system according to FIG. 1.
Figure 4:
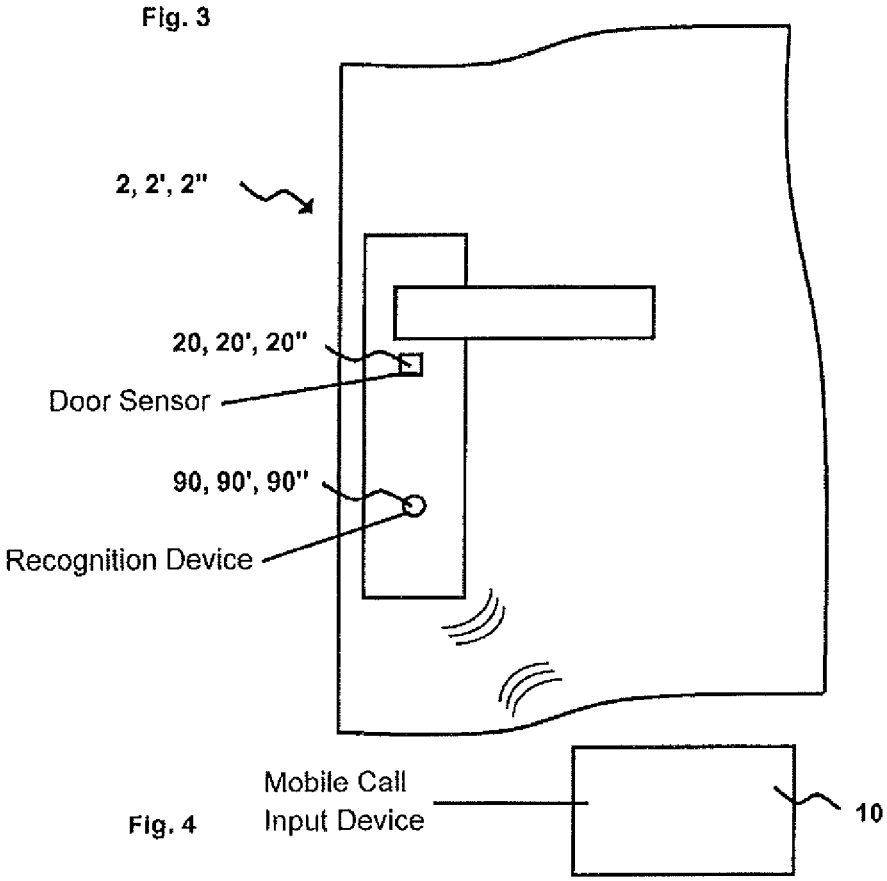
FIG. 4 is a view of a part of a second embodiment of a building door with door sensor for the elevator system according to FIG. 1.
Figure 7:
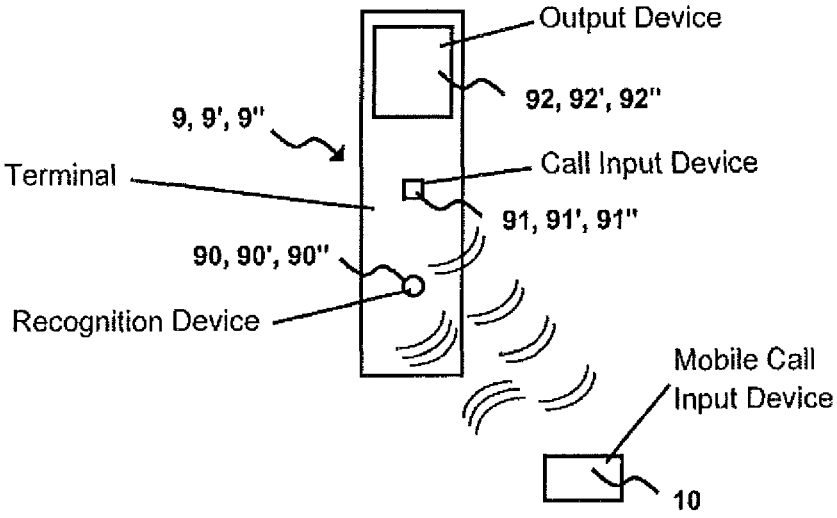
FIG. 7 is a view of a part of a third embodiment of a terminal for the elevator system according to FIG. 1.
Figure 8:
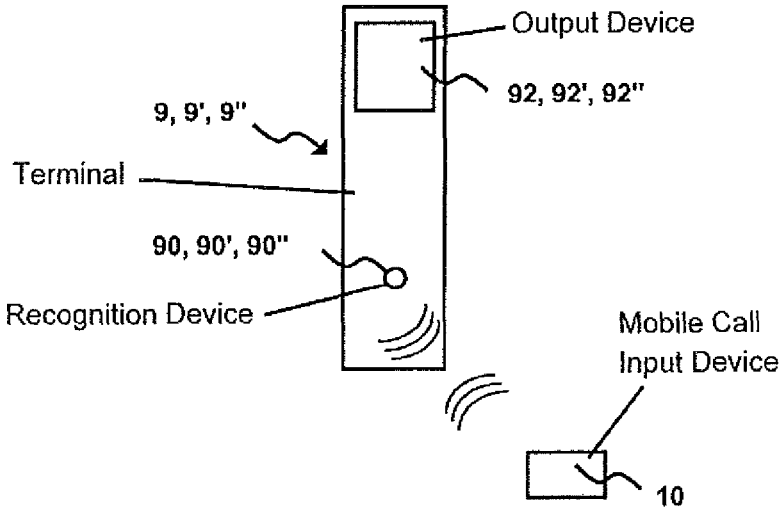
FIG. 8 is a view of a part of a fourth embodiment of a terminal for the elevator system according to FIG. 1.
Figure 9:
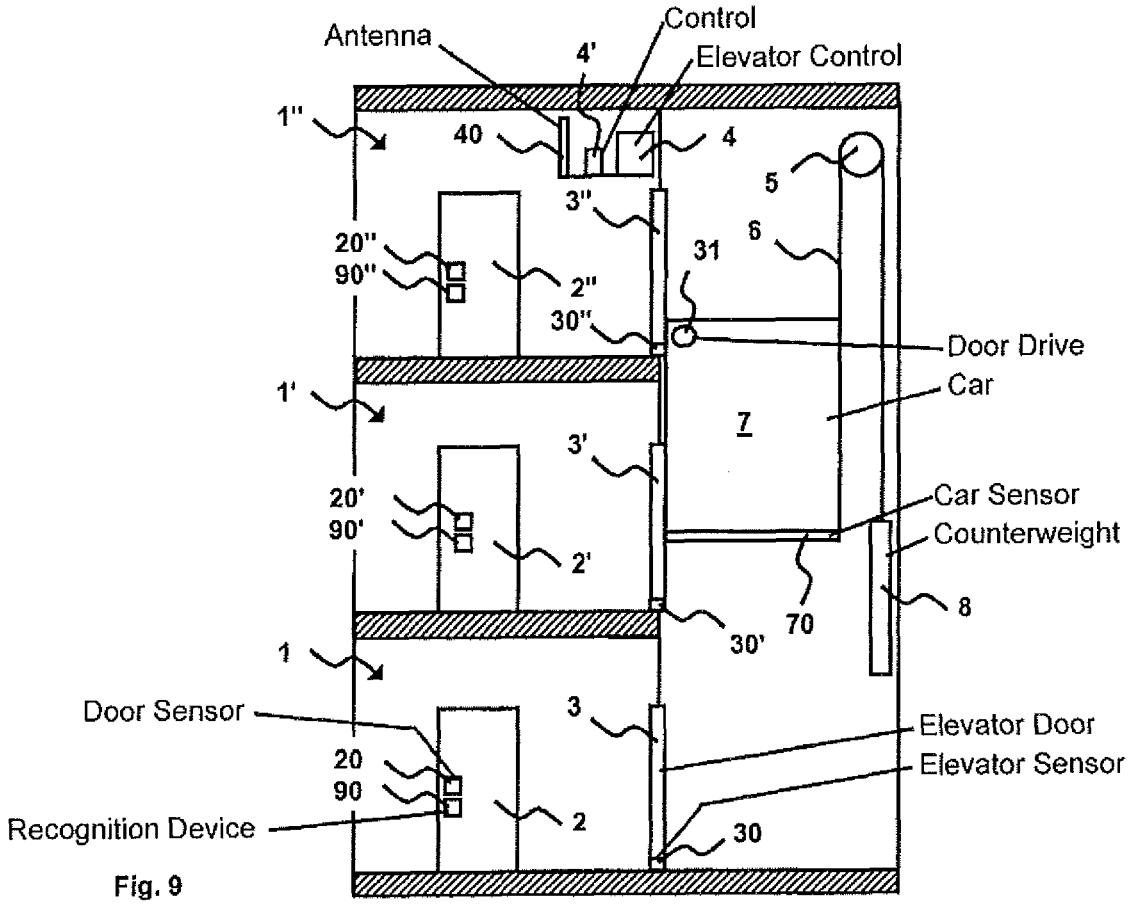
FIG. 9 is a partially sectioned view of a part of a retrofitted elevator system in a building.
Figure 10:
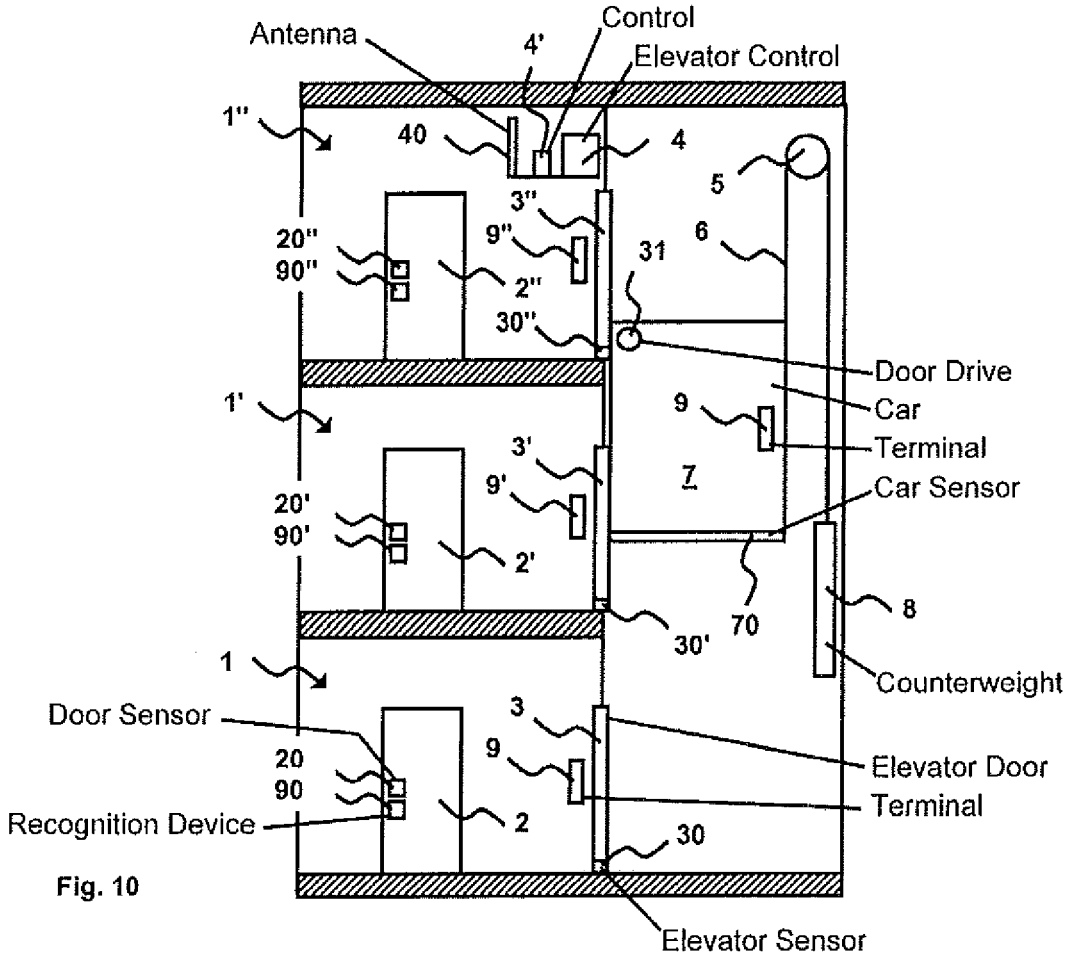
FIG. 10 is a partially sectioned view of a part of a further retrofitted elevator system in a building according to FIG. 9.

FIGS. 1 to 10 show examples of embodiment of the invention, wherein FIG. 1 shows an elevator system in a building, FIG. 2 shows a network of the elevator system, FIGS. 3 and 4 show two embodiments of a building door with door sensor for the elevator system, FIGS. 5 to 8 show four embodiments of a terminal for the elevator system and FIGS. 9 and 10 show a retrofitted elevator system in a building.

According to FIG. 1, the building has several floors 1, 1', 1" with at least one building door 2, 2', 2" giving access to at least one space. The building door 2, 2', 2" is an access door to an apartment in the building and/or an access door to the building. An elevator system is arranged in the building. The elevator system includes, in an elevator shaft, at least one elevator car 7 which is connected to at least one counterweight 8 via at least one support means 6. To move the elevator car 7 and counterweight 8, the support means 6 is put into motion frictionally by at least one elevator drive 5. At least one user has access to the elevator car 7 via at least one elevator door 3, 3', 3". At least one elevator door 3, 3', 3" is usually arranged in each floor 1, 1', 1". The elevator system can have more than one elevator car in an elevator shaft or also several elevator cars in several elevator shafts.

The operation of the elevator doors 3, 3', 3" occurs in a manner known per se by way of a door drive 31. At least one elevator control 4 controls the elevator drive 5 and the door drive 31. In order for the elevator control 4 to know when an elevator car 7 has arrived in a floor 1, 1', 1", at least one elevator sensor 30, 30', 30" detects the arrival of the elevator car 7 in the floor 1, 1', 1". For a detected arrival of the elevator car 7 in a floor 1, 1', 1", the elevator sensor 30, 30', 30" communicates at least one elevator car signal to the elevator control 4. Upon communication of an elevator car signal, the elevator control 4 opens the elevator door 3, 3', 3" of the floor 1, 1', 1".

The elevator car 7 has at least one car sensor 70 in the form of a load mat, for example, which is mounted on the floor of the elevator car 7 and communicates an elevator car use signal to the elevator control 4 in the event of weight loading by at least one user. Load sensors at the fastening of the support means or movement reporting devices in the elevator car, etc., come into consideration as alternative embodiments of a car sensor 70.

FIG. 2 shows a network of the elevator system. The elevator sensors 30, 30', 30" of the elevator shaft as well as recognition devices 90, 90', 90", call input devices 91, 91', 91" and output devices 92, 92', 92" of the terminal 9, 9', 9" as well as the car sensor 70 of the car 7 are connected to the elevator control 4 by way of a fixed network.

The building door 2, 2', 2" has a door leaf, a door frame and a door-step. Opening and closing the building door 2, 2', 2" means that the door leaf performs a movement relative to the doorstep. Even a minimal relative movement reveals the user's wish to cross the doorstep.

Door sensors 20, 20', 20", and recognition devices 90, 90', 90" of the building doors 2, 2', 2" are connected to an antenna 40 of the elevator control 4 by way of a radio network, e.g. Wireless Local Area Network (WLAN) according to the Standard IEEE802.11 or Worldwide Interoperability for Microwave Access (WIMAX) according to the Standard IEEE802.16.

Both the fixed network and the radio network allow a bidirectional communication according to known and proven network protocols such as the Transmission Control Protocol/Internet Protocol (TCP/IP) or Internet Packet Exchange (IPX). The fixed network has, for example, several electrical and/or optical data cables which are laid in the building under plaster, for example, or also suspended in the elevator shaft and thus connect the terminals 9, 9', 9" with the elevator control 4 and the elevator car 7 with the elevator control 4. Obviously, the elevator sensors 30, 30', 30" of the elevator shaft, the recognition devices 90, 90', 90", call input devices 91, 91', 91" and output devices 92, 92', 92" of the terminals 9, 9', 9" or the car sensor of the elevator car 7 can also be connected to the elevator control 4 by way of a radio network.

The door signal communicates to the elevator control 4 the expression of the user's wish to use the elevator system. A door signal is sufficient for this purpose. For example, a door signal is communicated to the elevator control 4 as soon as the building door 2, 2', 2" is opened even only by a small gap. In order to ensure that the user not only opens the building door 2, 2', 2", but also goes through the door frame and closes the building door 2, 2', 2" again, a door signal is communicated to the elevator control 4 as soon as the building door 2, 2', 2" is closed again. In order to further ensure that the user actually moves in the direction of an elevator door 3, 3', 3" a door signal is communicated when a building door 2, 2', 2" is opened from a side facing away from the elevator door 3, 3', 3" and/or when the building door 2, 2', 2" is closed from a side facing away from the elevator door 3, 3', 3".

FIGS. 3 and 4 show two embodiments of a building door 2, 2', 2" with door sensor 20, 20', 20" for the elevator system. The door sensor 20, 20', 20" is integrated in the building door 2, 2', 2". For example, the door sensor 20, 20', 20" is integrated in the door hardware and is thus not perceptible to users from the outside. When the building door 2, 2', 2" is closed, the door latch of the door hardware is detented in a lock plate of a door frame. By moving the door handle, the door latch is released from the lock plate of the door frame and the building door 2, 2', 2" is opened. The door sensor 20, 20', 20" detects the movement of the door handle, for example by means of an electromechanical contact. In a first contact setting, the door latch is detented in the lock plate and in a second contact setting the door latch is released from the lock plate. Opening of the building door 2, 2', 2" thus corresponds to a movement of the door 4 handle from a first contact setting into a second contact setting. Closing the building door 2, 2', 2" thus corresponds to a movement of the door handle from a second contact setting into a first contact setting. The door sensor 20, 20', 20" detects this opening or closing of the building door 2, 2', 2" and communicates at least one door signal to the elevator control 4.

Alternatively, it is obviously also possible to arrange the door sensor externally at a building door 2, 2', 2" or near a building door 2, 2', 2". Thus, the door sensor can be a movement recording device which is arranged in the door frame of the building door or in a building wall near the building door. It is also possible for the door sensor to be a load mat which is arranged on the floor in front of or near the building door. In that case, opening of the building door is associated with detection of a movement by the movement reporting device or with the detection of a load by the load mat. Correspondingly, closing of the building door is associated with the absence of detection of a movement by the movement recording device or with the absence of detection of a load by the load mat. In addition, it is also possible to combine several of the door sensors with one another and to suitably communicate combined door signals to the elevator control.

In the embodiment of the building door 2, 2', 2" according to FIG. 4 at least one recognition device 90, 90', 90" is additionally integrated in the building door 2, 2', 2". The recognition device 90, 90', 90" comprises a transmitting and receiving unit for an electromagnetic field and communicates by way of a radio frequency with at least one mobile call input device 10 located at the user. The call input device 10 is, for example, a Radio Frequency Identification (RFID) card which is known per se. As soon as such a call input device 10 is in the detection range of the recognition device 90, 90', 90", an identification code which the call input device 10 includes is emitted and received and evaluated by the recognition device 90, 90', 90". The transmitted identification code is recognized in accordance with a recognition protocol by the recognition device 90, 90', 90". This has a processor and a data store for this. The recognized identification code is communicated to the elevator control 4 as a user recognition signal.

Whereas only one door signal is communicated to the elevator control 4 in the embodiment of a building door 2, 2', 2" according to FIG. 3, the communication of a door signal and a user recognition signal to the elevator control 4 is carried out in the embodiment of a building door 2, 2', 2" according to FIG. 4. Upon communication of only a door signal to the elevator control 4, the elevator control 4 defines the floor of the communicated door signal as a start floor and actuates a start call for an elevator car 7 to the start floor. A destination call predefined for the start floor is actuated by the elevator control 4. Upon additional communication of a user recognition signal to the elevator control 4, the elevator control 4 identifies the communicated user recognition signal. The elevator control 4 has for that purpose at least one user data memory and at least one computing processor. The computing processor identifies the communicated user recognition signal with a predefined destination call stored in the user data memory.

At least one terminal 9, 9', 9" is arranged in a stationary manner near the elevator doors 3, 3', 3" on each story 1, 1', 1". An identical or similar terminal 9 is also arranged in the elevator car 7. As illustrated in FIGS. 5 to 8 in detail, at least one stationary call input device 91, 91', 91" and at least one stationary output device 92, 92', 92" are arranged in the housing of the terminal 9, 9', 9". The terminal 9, 9', 9" is, for example, mounted on a building wall or elevator car wall or stands isolated in a space in front of the elevator door 3, 3', 3".

Figure 5:
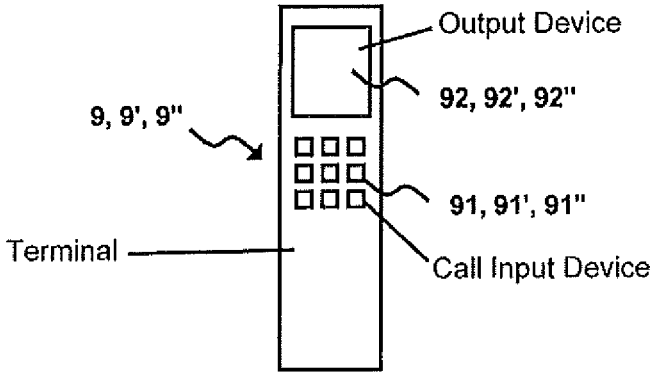
FIG. 5 is a view of a part of a first embodiment of a terminal for the elevator system according to FIG. 1.

In the first embodiment of a terminal 9, 9', 9" according to FIG. 5, the user actuates a destination call with the stationary call input device 91, 91', 91" in the form of a keypad, in which the user presses at least one key by hand. For example, the user inputs the destination floor "20" by hand as numerical sequence "2" and "0" on the keypad. The user obtains an optical and/or acoustic confirmation of the actuated destination call on the stationary output device 92, 92', 92". The keypad can also be a touch-sensitive screen.

Figure 6:
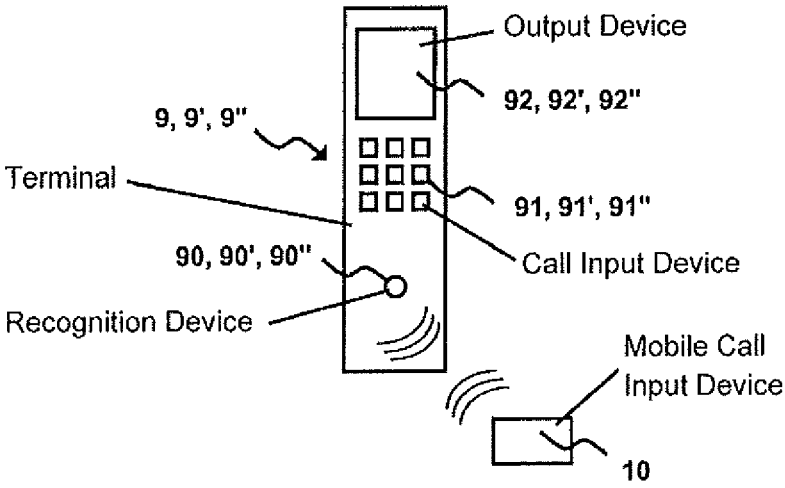
FIG. 6 is a view of a part of a second embodiment of a terminal for the elevator system according to FIG. 1.

In the further embodiments of a terminal 9, 9', 9" according to FIGS. 6 to 8 at least one stationary recognition device 90, 90', 90" is arranged in the housing of the terminal 9, 9', 9" like the above previously described identification device. An identification code recognized by the stationary recognition device 90, 90', 90" is communicated to the elevator control 4 as a user recognition signal. The elevator control 4 with its computing processor and user data memory identifies the communicated user recognition signal with a predefined destination call stored in the user data memory. The elevator control 4 actuates this predefined destination call for the elevator car 7 to a destination floor. The user thus contactlessly actuates a destination call with the mobile call input device 10 by way of the stationary recognition device 90, 90', 90". In these embodiments of a terminal 9, 9', 9" too, the user obtains on the stationary output device 92, 92', 92" an optical and/or acoustic confirmation of the actuated destination call.

A user can change an actuated destination call with the stationary call input device 91, 91', 91" and/or with the mobile call input device 10.

In the first and second embodiments of a terminal 9, 9', 9" according to FIGS. 5 and 6, the stationary call input device 91, 91', 91" is a keypad by means of which the user can change the destination call by hand.

In the third embodiment of a terminal 9, 9', 9" according to FIG. 7, the stationary call input device 91, 91', 91" includes a proximity sensor, for example an infrared sensor, which converts a movement by the user into a cursor movement over possible destination call displays on the stationary output device 92, 92', 92". Thus, the user can, by movement of a hand, move a cursor over possible destination call displays and, by stopping the hand, stop the cursor over a destination call display and thus actuate a corresponding changed destination call.

In the fourth embodiment of a terminal 9, 9', 9" according to FIG. 8, the recognition device 90, 90', 90" converts the reception or non-reception of an identification code of the mobile call input device 10 into a cursor movement over possible destination call indications on the stationary output device 92, 92', 92". For example, the range of the electromagnetic field for energy activation of the mobile call input device 10 amounts to a few centimeters. If the user now holds the mobile call input device 10 in the range of the electromagnetic field, the cursor moves over possible destination call displays. However, as soon as the user holds the mobile call input device 10 out of the range of the electromagnetic field, the cursor movement then stops over a possible destination call display and actuates a corresponding changed destination call.

FIGS. 9 and 10 show a retrofitted elevator system in a building. The building has the features already described using FIG. 1. An existing elevator is arranged in the building. When further describing the existing elevator, reference shall be made hereafter to the terms and sequences introduced when describing the elevator in FIG. 1.

To retrofit the existing elevator to an elevator system as described above, at least one door sensor 20, 20', 20" and where applicable also an identification device 90, 90', 90" is installed in at least one building door 2, 2', 2". Alternatively, installation near the building door 2, 2', 2" is also possible for the door sensor 20, 20', 20" and the identification device 90, 90', 90". The entire existing building door 2, 2', 2" can be replaced by a building door 2, 2', 2" with an integrated door sensor 20, 20', 20" or a building door 2, 2', 2" with an integrated door sensor 20, 20', 20" and an integrated identification device 90, 90', 90". Furthermore, an antenna is provided such that the door sensor 20, 20', 20" and the identification device 90, 90', 90" can communicate a door signal or a user recognition signal via a radio network to the control 4'.

Furthermore, at least one control 4' and one elevator control 4 are installed or adapted for retrofitting. The control 4' communicates, as described above, with the door sensor 20, 20', 20" and the elevator control 4. The control 4' defines the floor 1, 1', 1" of a communicated door signal as a start floor and actuates a start call for the elevator car 7 to the start floor. For example, the control 4' is connected to at least one signal input of the elevator control 4 and actuates the start call by way of this signal input. For a detected arrival of the elevator car 7 in the start floor, at least one elevator car signal is communicated to the elevator control 4 by the elevator sensor 30, 30', 30". The elevator door 3, 3', 3" of the start floor is opened by the elevator control 4 upon communication of an elevator car signal. As an alternative to the installation of a control 4' and/or elevator control 4, it is possible to also consider replacing an existing control 4'/elevator control 4 by a new control 4'/elevator control 4 in accordance with the above comments, in particular with regard to FIGS. 1 and 2, wherein a new elevator control 4 can also have a combined functionality of the previous control 4' and the previous elevator control 4.

To retrofit the existing elevator to an elevator system, in an additional step at least one terminal 9, 9', 9" of the type mentioned above in conjunction with FIGS. 5 to 8 is arranged in a stationary manner on each floor 1, 1', 1" near an existing elevator door 3, 3', 3" and/or a terminal 9 is arranged in the elevator car 7.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method, comprising:

detecting movement of a building door on a floor of a building;

based on the detected movement of the building door, defining the floor of the building as a start floor for an elevator trip with an elevator system in the building; and based on the detected movement of the building door, placing a predefined destination call for the elevator trip.

2. The method of claim 1, the detected movement of the building door comprising an opening of the building door.

3. The method of claim 1, the detected movement of the building door comprising a closing of the building door.

4. The method of claim 3, the detected movement of the building door further comprising an opening of the building door.

5. The method of claim 1, the detected movement of the building door comprising a movement of a door handle.

6. The method of claim 1, further comprising, based on the detected movement of the building door, opening an elevator door of an elevator car at the start floor.

7. The method of claim 6, further comprising moving the elevator car to the start floor based on the detected movement of the building door.

8. The method of claim 6, further comprising:

detecting that a passenger has entered the elevator car; and closing the elevator door.

9. The method of claim 1, further comprising determining an identity of a user, the placing the destination call being based on the identity of the user.

10. A method, comprising:

determining that a passenger is passing through a building door on a floor of a building;

based on the determining, defining the floor of the building as a start floor for an elevator trip with an elevator system in the building; and based on the determining, placing a predefined destination call for the elevator trip.

11. The method of claim 10, the determining comprising detecting the presence of a passenger using a sensor.

12. The method of claim 10, further comprising receiving a changed destination floor from the passenger.

13. The method of claim 10, the determining comprising determining a movement direction of the passenger.

14. A system, comprising:

a building door located on a floor of a building;

a sensor;

an elevator installation in the building; and a control unit, the control unit being coupled to the sensor and to the elevator installation, the control unit being configured to, detect movement of the building door using the sensor, based on the detected movement of the building door, define the floor of the building as a start floor for an elevator trip with the elevator installation, and based on the detected movement of the building door, place a predefined destination call for the elevator trip.

15. The system of claim 14, further comprising a recognition device coupled to the control unit.

16. The system of claim 14, the sensor comprising an electromechanical contact.

17. The system of claim 14, the sensor comprising a weight sensor.

18. The system of claim 14, the sensor comprising a movement recording device.

19. The system of claim 14, the sensor being integrated into the building door.

20. An elevator control unit, comprising:

a processor; and a memory, the elevator control unit being programmed to, detect movement of a building door on a floor of a building, based on the detected movement of the building door, define the floor of the building as a start floor for an elevator trip with an elevator system in the building, and based on the detected movement of the building door, place a predefined destination call for the elevator trip.

* * * * *